US005240240A

United States Patent [19]

Magee et al.

[11] Patent Number: 5,240,240

[45] Date of Patent: Aug. 31, 1993

[54] REMOTE PIN CONTROL FOR SIGNATURE INSERTER APPARATUS

[75] Inventors: Lawrence D. Magee, Bolingbrook; Ronald W. Hastie, Elk Grove Village, both of Ill.

[73] Assignee: R. R. Donnelley & Sons Company, Lisle, Ill.

[21] Appl. No.: 880,674

[22] Filed: May 8, 1992

[51] Int. Cl.[5] ..... B65H 3/08

[52] U.S. Cl. ..... 271/20; 271/31.1; 271/150; 271/169

[58] Field of Search ..... 271/31.1, 20, 149, 150, 271/167, 169

[56] References Cited

U.S. PATENT DOCUMENTS

| | | | |
|---|---|---|---|
| 2,642,285 | 6/1953 | Baker | 271/149 |
| 3,210,072 | 10/1965 | Baker | 271/31.1 |
| 3,893,664 | 7/1975 | Thomsen . | |
| 4,505,470 | 3/1985 | Reinert et al. . | |
| 4,641,489 | 2/1987 | Wood . | |

*Primary Examiner*—Richard A. Schacher
*Attorney, Agent, or Firm*—Wood, Phillips, VanSanten, Hoffman & Ertel

[57] ABSTRACT

In order to facilitate adjustment of the height of impaling pins, a signature supply station includes a pair of generally parallel side frame members each of which supports a rotatable impaling pin adjustment assembly. The adjustment assembly includes supporting structure for a pair of impaling pins whereby the pins are supported between the side frame members for guided movement in generally vertically upward and downward directions, and it also includes an adjusting screw rotatable in a clockwise and counterclockwise direction. With the signature supply station supporting signatures generally vertically, the adjustment assembly further includes interconnection structure or guided generally vertically upward and downward movement of the impaling pins responsive to clockwise and counterclockwise rotational movement of the adjusting screw.

15 Claims, 2 Drawing Sheets

REMOTE PIN CONTROL FOR SIGNATURE INSERTER APPARATUS

FIELD OF THE INVENTION

The present invention is generally directed to improving efficiency in signature inserter apparatus and, more particularly, a signature supply station for a signature inserter apparatus having a remote adjustment feature.

BACKGROUND OF THE INVENTION

In recent years, there have been significant advancements in technology relating to signature inserter apparatus. It will be appreciated in this connection that a signature inserter apparatus comprises a device of the type which is utilized to deliver signatures from a signature supply station to a gathering chain or the like on a binding line. Oftentimes, the signature inserter apparatus will employ multiple vacuum suckers for repeatedly drawing signatures to griping fingers.

Generally speaking, a signature supply station will be provided with signatures that are generally vertically positioned. Specifically, the signatures will typically rest on their backbones on an indexing conveyor or the like wherein the lead one of the signatures at any point in time will have its backbone resting against a pair of impaling pins When a reciprocating vacuum sucker arm contacts the lead signature, it pulls it over the impaling pins to the gripping fingers.

When this occurs, the impaling pins then restrain the next one of the signatures. It is held in position, i.e., it then becomes the next lead signature, until the reciprocating vacuum sucker arm returns. At that point, the process is repeated, and this continues to occur in cyclical fashion.

In other words, the reciprocating vacuum sucker arm delivers the signatures from the signature supply station one at a time by pulling the signatures over the impaling pins, and the impaling pins then restrain the signatures at the signature supply station until the reciprocating vacuum sucker arm returns in its next cycle of operation.

While all of this is known in the art, it is also known that the impaling pins periodically require an adjustment for efficient operation. More to the point, a variety of factors may dictate the desirability and/or necessity of adjusting the impaling pins generally vertically upward or downward depending upon the type and nature of signatures being handled and other parameters associated with the operation of the signature inserter apparatus. In the past, this has been a laborious and time consuming project inasmuch as the impaling pins were raised and lowered in a difficult, manual fashion.

Specifically, the impaling pins have typically been raised and lowered by hand. This occurs only after a set screw is loosened, following which the set screw must again be tightened in order to lock the impaling pins in their new position of adjustment. As will be appreciated, this has proven to be unsatisfactory for a variety of reasons.

Most obviously, the adjustment of the impaling pins has required the signature inserter to be disabled This, of course, requires not only disablement of a particular signature inserter but, usually, disablement of the entire binding line which is most costly in terms of the operating efficiency of a bindery facility Still additionally, the manual adjustment typically comprises a trial and error procedure.

In this connection, the impaling pins are typically adjusted in an independent fashion. There is thus always at least a reasonable possibility that, not only will the selected degree of adjustment be improper, but one impaling pin may be adjusted to a different degree in relation to the other impaling pin. As a result, it has remained to provide a means of improving upon this cumbersome procedure.

The present invention is directed to overcoming one or more of the foregoing problems and achieving one or more of the resulting objects.

SUMMARY OF THE INVENTION

Accordingly, it is a principal object of the present invention to provide significant improvement in a signature supply station for a signature inserter apparatus. It is a further object of the present invention to provide such improvements wherein remote simultaneous adjustment of impaling pins can be made. Additionally, it an object of the present invention to provide such improvements in a signature supply station requiring little or no signature inserter downtime.

To achieve these objects, the present invention is directed to a signature supply station having a pair of generally parallel side frame members each of which includes means for supporting a rotatable impaling pin adjustment assembly. The adjustment assembly includes means for supporting a pair of impaling pins between the side frame members for guided movement in generally vertically upward and downward directions and an adjusting screw rotatable in a clockwise and counter-clockwise direction. With the signatures supported generally vertically, the adjustment assembly further includes interconnection means for guided movement of the impaling pins generally vertically in response to rotational movement of the adjusting screw.

In the exemplary embodiment of the present invention, the adjusting screw is mounted to one of the side frame members for movement limited to rotation in a clockwise and counter-clockwise direction. It is also a feature that the interconnection means simultaneously converts rotational movement of the adjusting screw to linear movement to both of the impaling pins for vertical positioning. As a result, the interconnection means directionally guides generally vertical movement of the impaling pins in direct response to clockwise and counter-clockwise rotation of the adjusting screw.

In a most highly preferred embodiment, the supporting means includes a pair of pin guide blocks each having a generally vertical angularly disposed impaling pin slot. Each of the impaling pin slots preferably directionally guides linear generally vertical movement of one of the impaling pins therewithin. Further, each of the pin guide blocks is preferably fixedly mounted in opposed relation on an inwardly facing surface of one of the side frame members.

Still additionally, the interconnection means preferably includes a pair of adjusting rings each mounted for rotation on hubs carried by the side frame members. The rotational movement will be in a clockwise and counter-clockwise direction relative to the common axis of the adjusting rings and hubs. With this arrangement, the interconnection means further includes means for converting rotational movement of the adjusting screw to rotational movement of the adjusting rings.

As to other details of the present invention, the interconnection means preferably includes corresponding pairs of adjusting rings and clamps. It is advantageous for each of the clamps to be fixedly secured to one of the adjusting rings and the clamps are also preferably joined to one another by a tie bar. Further, the movement converting means preferably includes a pivot block joining the adjusting screw to one of the clamps for imparting rotational movement.

Preferably, the adjusting rings each include a slot and fastener arrangement for limiting rotational movement relative to the common axis of the adjusting rings and hubs. More specifically, a fastener advantageously extends through the slots in each of the adjusting rings and through a fastener receiving opening in the corresponding one of the pin guide blocks. With this arrangement, the fasteners fixedly secure the pin guide blocks to the corresponding one of the side frame members while limiting rotation of the adjusting rings.

In a most highly preferred embodiment of the present invention, each of the adjusting rings includes a cam slot and each of the impaling pins includes a cam finger. Each of the cam fingers advantageously project from an impaling pin supporting block into the cam slot of the corresponding one of the adjusting rings. Preferably, the impaling pin supporting blocks are sized and shaped to correspond to the size and shape of the impaling pin slots in the pin guide blocks.

Other objects, advantages and features of the present invention will become apparent from a consideration of the following specification taken in conjunction with the accompanying drawings.

DETAILED DESCRIPTION OF THE PREFERRED EMBODIMENT

Figure 1:
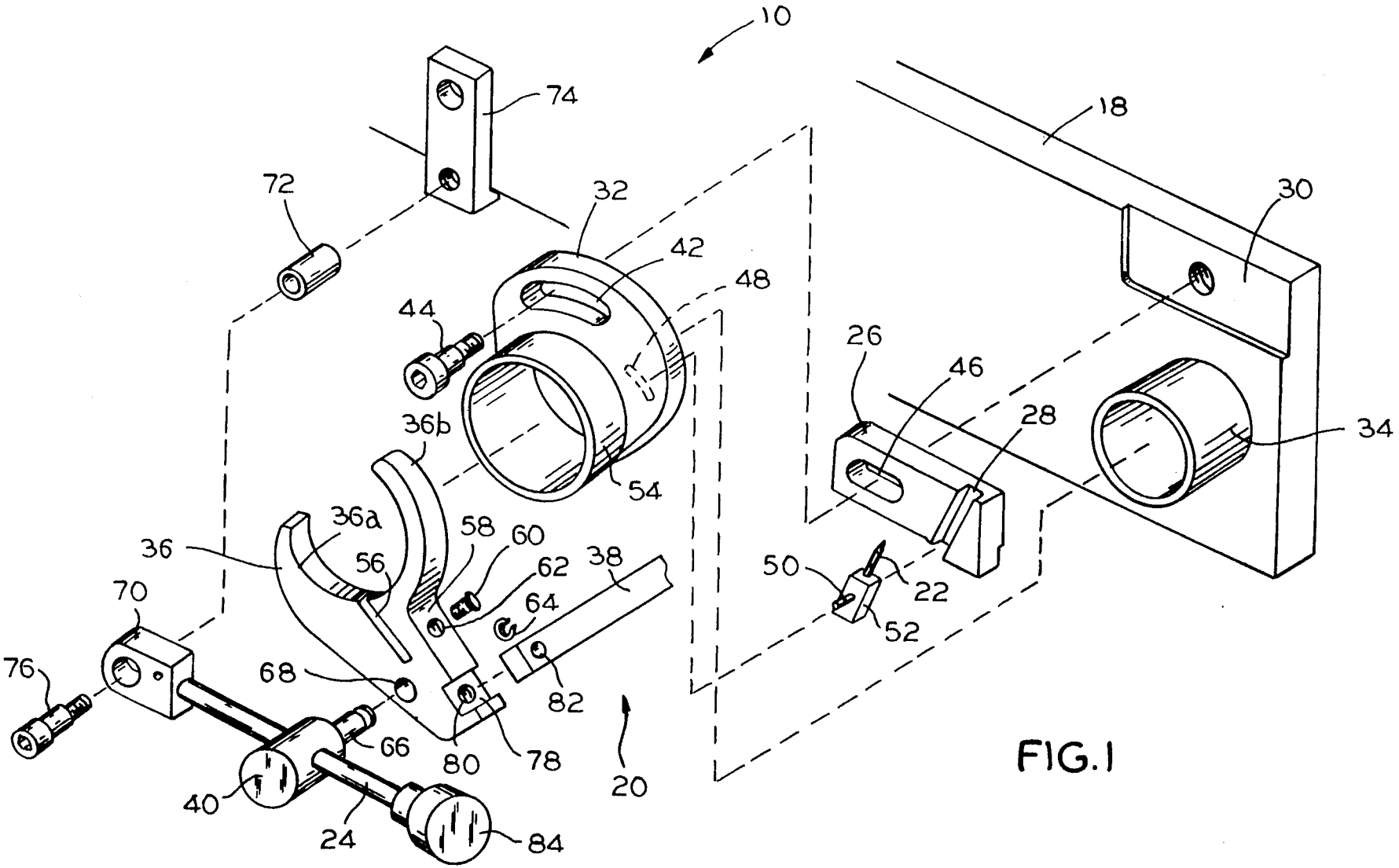
FIG. 1 is an exploded perspective view of a remote adjustment assembly for a signature supply station in accordance with the present invention.
Figure 2:
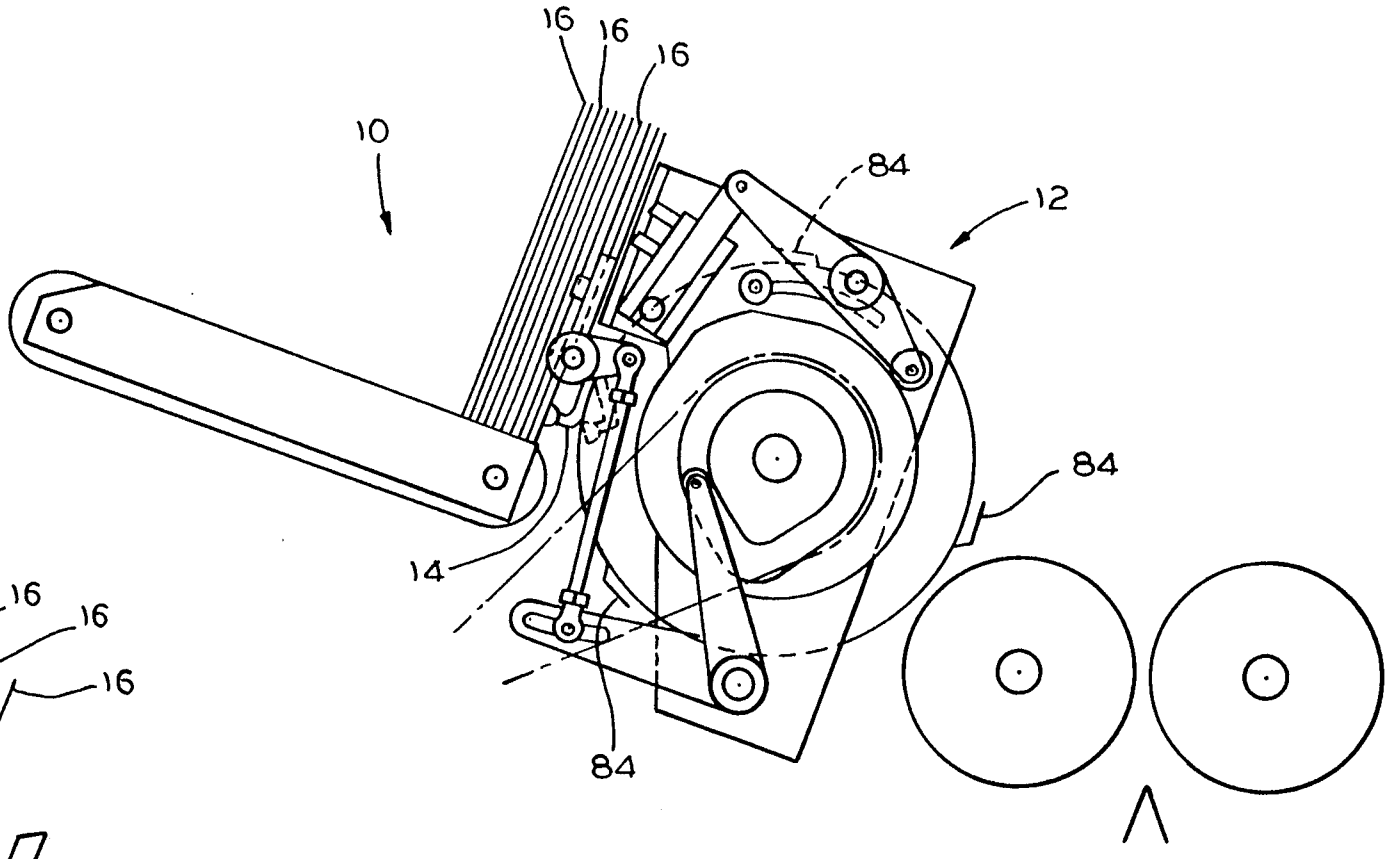
FIG. 2 is a generally schematic illustration of a signature inserter apparatus that utilizes a remote adjustment assembly.

In the illustrations given, and with reference first to FIGS. 1 and 2, the reference numeral 10 designates generally a signature supply station in accordance with the present invention. The signature supply station 10 is useful with a signature inserter apparatus 12 having vacuum suckers 14 for removing signatures 16 one at a time from the signature supply station 10. As will be appreciated from FIGS. 2 and 3, the signature supply station 10 supports the signatures 16 in a generally vertical orientation in proximity to the signature inserter apparatus 12.

Referring to FIG. 1, the exploded perspective view is provided so as to best illustrate one portion of the signature supply station 10. It will be appreciated that this portion comprises the right side of the signature supply station 10 with the left side thereof comprising a mirror image except as otherwise noted below. As used herein, reference to any particular component will be understood to also have reference to its mirror image component even if not specifically shown.

As will be appreciated by referring to FIG. 2, the signature supply station 10 includes a pair of generally parallel side frame members such as 18 each of which includes means for supporting a rotatable impaling pin adjustment assembly generally designated 20. The adjustment assembly 20 includes means for supporting a pair of impaling pins such as 22 between the side frame members such as 18 for guided movement in a generally vertically upward and downward direction as well as a single adjusting screw 24 rotatable in a clockwise and counter-clockwise direction. With this understanding of the signature supply station 10, the adjustment assembly 20 will further include interconnection means for guided movement of the impaling pins such as 22 responsive to rotation of the single adjusting screw 24.

Still referring to FIG. 1, the single adjusting screw 24 will be seen to be mounted to the one of the side frame members 18 for movement limited to rotation in a clockwise and counter-clockwise direction. It will also be appreciated, and discussed in further detail below, that the interconnection means accommodates directionally guided movement of the impaling pins in direct response to clockwise and counter-clockwise rotation of the single adjusting screw 24. Specifically, the interconnection means will be understood to simultaneously convert rotational movement of the single adjusting screw 24 to linear movement of both of the impaling pins such as 22.

As will be appreciated, the supporting means includes a pair of pin guide blocks such as 26 each having a generally vertical angularly disposed impaling pin slot such as 28. Each of the impaling pin slots such as 28 directionally guides linear movement of one of the impaling pins such as 22 therewithin. Additionally, each of the pin guide blocks such as 26 is fixedly mounted in opposed relation on an inwardly facing surface such as 30 of one of the side frame members such as 18.

As for the interconnection means, it will be seen to include a pair of adjusting rings such as 32 each of which is mounted for rotation in a clockwise and counter-clockwise direction. The adjusting rings such as 32 are mounted on hubs such as 34 carried by the side frame members such as 18. Still additionally, the interconnection means includes means for converting rotational movement of the single adjusting screw 24 to rotational movement of the adjusting rings such as 32.

As suggested hereinabove, the interconnection means actually includes a corresponding pair of adjusting rings such as 32 and clamps such as 36 each of which is fixedly secured to one of the adjusting rings such as 32. The clamps such as 36 are also joined to one another by means of a single tie bar 38. With this arrangement, the movement converting means includes a single pivot block 40 joining the single adjusting screw 24 to one of the clamps such as 36 for imparting rotational movement to both of the adjusting rings such as 32.

As shown in FIG. 1, each of the adjusting rings such as 32 includes a slot such as 42 for limiting rotational movement by means of a fastener such as 44 which extends through each of the slots such as 42. It will also be seen that each of the fasteners such as 44 extends through a fastener receiving opening such as 46 in the corresponding one of the pin guide blocks such as 26. With this arrangement, the fasteners such as 44 are designed to fixedly secure the pin guide blocks such as 26 to the corresponding one of the side frame members such as 18 while limiting rotation of the adjusting rings such as 32.

As also shown in FIG. 1, each of the adjusting rings such as 32 includes a cam slot such as 48 and each of the impaling pins such as 22 includes a cam finger such as 50. The cam fingers such as 50 each will be understood to project from an impaling pin supporting block such as 52 into the cam slot such as 48 of the corresponding one of the adjusting rings such as 32. The impaling pin supporting blocks such as 52 are sized and shaped to correspond to the size and shape of the impaling pin slots such as 28 in the pin guide blocks such as 26.

During assembly, the impaling pin supporting blocks such as 52 are laid into the impaling pin slots such as 28 in the pin guide blocks such as 26. The adjusting rings such as 32 are then pushed over the hubs on the side frame members with the cam fingers such as 50 fitted into the cam slots such as 48 for movement therewithin. With this accomplished, the clamps such as 36 are each fitted onto a hub such as 54 on an adjustment ring such as 32 as suggested in the illustration in FIG. 1.

As will be appreciated, the clamps such as 36 include two generally arcuate finger portions such as 36*a* and 36*b* which will be seen to be adapted to fit onto the hub on the corresponding adjusting ring. There is also provided a slot such as 56 which extends from between the arcuate finger portions for some distance into the arm such as 58 on the clamps such as 36. With this arrangement, a threaded fastener such as 60 may be tightened within a threaded bore such as 62 to cause the arcuate finger portions to tightly grip the hub of the corresponding adjusting ring in nonslip fashion.

With this accomplished, the pivot block 40 is attached to the arm 58 of the clamp 36 by means of a retaining ring 64 which allows the stem 66 of the pivot block 40 to rotate freely within the bore 68 in the arm 58 of the clamp 36. At that point, the adjusting screw 24 is threaded into a threaded bore in the pivot block 40 and a yoke 70 is attached to one end of the adjusting screw 24 in any conventional manner allowing free rotation thereof. With this done, the yoke 70 and spacer 72 are secured to a bracket 74 attached to the side frame member 18 by means of a threaded fastener 76 or the like to substantially complete assembly of the components of the adjustment assembly 20.

As previously discussed, the single tie bar 38 spans the distance between the clamps such as 36 and it can be secured to them in any conventional manner so as to impart rotational movement from one to the other of the clamps. By way of example, the clamps such as 36 may have a bar receiving slot 78 and an internally threaded hole such as 80 to mate with a corresponding hole such as 82 in the tie bar 38 to receive a threaded fastener (not shown). With the tie bar 38, the handle 82 on the adjusting screw 24 can be turned clockwise or counter-clockwise to impart rotation to the entire adjustment assembly 20 by reason of this linking of the opposed components.

In other words, as the adjusting screw 24 is rotated, the clamps and the adjusting rings are rotated causing the impaling pins to move generally vertically upward and downward within the impaling pin slots. The tie bar 38, as discussed, causes both impaling pins such as 22 (one per side) to move together by an equal amount. As a result, it will be appreciated that the degree to which the impaling pins project upwardly to hold the signatures can be adjusted easily and efficiently in a uniform manner by simply rotating the handle 82.

Figure 3:
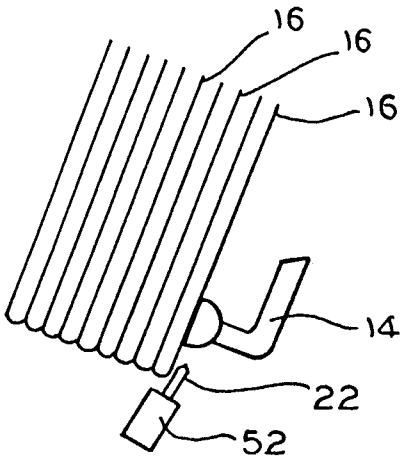
FIG. 3 is a generally schematic illustration of impaling pin restraint of generally vertical signatures at a signature supply station.

As will be appreciated by referring to FIG. 3, the impaling pins such as 22 are utilized to hold back the signatures 16 until they are to be delivered to the signature inserter apparatus 12. The impaling pins hold the lead one of the signatures 16 until the vacuum suckers 14 pull it away from the remainder of the stack of signatures for delivery to the gripping clips 84 in one-at-a-time fashion. When the lead one of the signature 16 has cleared the impaling pins such as 22, the impaling pins serve to hold the next lead one of the signatures 16 until the cycle once again is repeated.

While in the foregoing there has been set forth a preferred embodiment of the invention, it will be appreciated that the details herein given may be varied by those skilled in the art without departing from the true spirit and scope of the appended claims.

I claim:

1. In a signature supply station for a signature inserter apparatus, said signature inserter apparatus having vacuum suckers for removing signatures one at a time from said signature supply station, said signature supply station supporting signatures generally vertically, the improvement comprising:

a pair of generally parallel side frame members each of which includes means for supporting a rotatable impaling pin adjustment assembly, said adjustment assembly including means for supporting a pair of impaling pins between said side frame members for guided movement in generally vertically upward and downward directions and an adjusting screw rotatable in a clockwise and counterclockwise direction, said adjustment assembly further including interconnection means for guided movement of said impaling pins responsive to rotation of said adjusting screw.

2. The signature supply station of claim 1 wherein said supporting means includes a pair of pin guide blocks each of which has a slot for guided movement of one of said impaling pins.

3. The signature supply station of claim 1 wherein said interconnection means includes a pair of adjusting rings each of which is rotatable in a clockwise and counterclockwise direction.

4. The signature supply station of claim 3 wherein said interconnection means further includes means for operatively joining said adjusting screw to both of said adjusting rings.

5. The signature supply station of claim 3 wherein said interconnection means further includes means for operatively joining each of said adjusting rings to one of said impaling pins.

6. The signature supply station of claim 1 wherein said interconnection means converts rotational movement of said adjusting screw to linear movement of said impaling pins.

7. The signature supply station of claim 1 wherein said interconnection means causes simultaneous movement of said impaling pins in generally vertically upward and downward directions.

8. In a signature supply station for a signature inserter apparatus, said signature inserter apparatus having vacuum suckers for removing signatures one at a time from said signature supply station, said signature supply station supporting signatures generally vertically, the improvement comprising:

a pair of generally parallel side frame members each of which includes means for supporting a rotatable impaling pin adjustment assembly, said adjustment assembly including means for supporting a pair of impaling pins between said side frame members for directionally guided movement in generally vertically upward and downward directions, said adjustment assembly also including an adjusting screw mounted to one of said side frame members for movement limited to rotation in a clockwise and counterclockwise direction, said adjustment assembly further including interconnection means for directionally guided movement of said impaling pins in direct response to clockwise and counterclockwise rotation of said adjusting screw, said interconnection means simultaneously converting rotational movement of said adjusting screw to linear movement of both of said impaling pins.

9. The signature supply station of claim 8 wherein said supporting means includes a pair of pin guide blocks, each of said pin guide blocks having a generally vertical angularly disposed impaling pin slot for directionally guided movement of one of said impaling pins, each of said pin guide blocks being mounted on an inwardly facing surface of one of said side frame members.

10. The signature supply station of claim 8 wherein said interconnection means includes a pair of adjusting rings each mounted for rotation in a clockwise and counterclockwise direction, said interconnection means further including means for simultaneously converting rotational movement of said adjusting screw to rotational movement of said adjusting rings.

11. The signature supply station of claim 8 wherein said interconnection means includes corresponding pairs of adjusting rings and clamps, each of said clamps being secured to one of said adjusting rings and being joined by a tie bar, said interconnection means including a pivot block joining said adjusting screw to one of said clamps for imparting rotation to said adjusting rings.

12. In a signature supply station for a signature inserter apparatus, said signature inserter apparatus having vacuum suckers for removing signatures one at a time from said signature supply station, said signature supply station supporting signatures generally vertically, the improvement comprising:

a pair of generally parallel side frame members each of which includes means for supporting a rotatable impaling pin adjustment assembly, said adjustment assembly including means for supporting a pair of impaling pins between said side frame members for directionally guided movement in generally vertically upward and downward directions, said adjustment assembly also including an adjusting screw mounted to one of said side frame members for movement limited to rotation in a clockwise and counterclockwise direction, said adjustment assembly further including interconnection means for directionally guided movement of said impaling pins in direct response to clockwise and counterclockwise rotation of said adjusting screw, said interconnection means simultaneously converting rotational movement of said adjusting screw to linear movement of both of said impaling pins;

said supporting means including a pair of pin guide blocks each having a generally vertical angularly disposed impaling pin slot, each of said impaling pin slots directionally guiding linear movement of one of said impaling pins therewithin, each of said pin guide blocks being fixedly mounted in opposed relation on an inwardly facing surface of one of said side frame members;

said interconnection means including a pair of adjusting rings each mounted for rotation in a clockwise and counterclockwise direction, said adjusting rings being mounted on hubs carried by said side frame members, said interconnection means further including means for converting rotational movement of said adjusting screw to rotational movement of said adjusting rings.

13. The signature supply station of claim 12 wherein said interconnection means includes corresponding pairs of adjusting rings and clamps, each of said clamps being fixedly secured to one of said adjusting rings and said clamps also being joined to one another by a tie bar, said movement converting means including a pivot block joining said adjusting screw to one of said clamps for imparting rotational movement to said adjusting rings.

14. The signature supply station of claim 13 wherein each of said adjusting rings includes a slot for limiting rotational movement, and including a fastener extending through each of said slots and through a fastener receiving opening in the corresponding one of said pin guide blocks, said fasteners fixedly securing said pin guide blocks to the corresponding one of said side frame members while limiting rotation of said adjusting rings.

15. The signature supply station of claim 14 wherein each of said adjusting rings includes a cam slot and each of said impaling pins includes a cam finger, each of said cam fingers projecting from an impaling pin supporting block into said cam slot of the corresponding one of said adjusting rings, said impaling pin supporting blocks being sized and shaped to correspond to the size and shape of the impaling pin slots in said pin guide blocks.

* * * * *